US006056514A

United States Patent [19]

Fukai

[11] Patent Number: 6,056,514

[45] Date of Patent: May 2, 2000

[54] VARIABLE-DISPLACEMENT COMPRESSOR OF A SWASH PLATE TYPE, IN WHICH DISPLACEMENT OF A DRIVE SHAFT IS SUPPRESSED

[75] Inventor: Isamu Fukai, Fujioka, Japan

[73] Assignee: Sanden Corporation, Gunma, Japan

[21] Appl. No.: 09/053,013

[22] Filed: Apr. 1, 1998

[30] Foreign Application Priority Data

Apr. 2, 1997 [JP] Japan ..... 9-083802

[51] Int. Cl.[7] ..... F04B 49/00; F01B 3/00

[52] U.S. Cl. ..... 417/223; 417/269; 92/71

[58] Field of Search ..... 417/269, 223, 417/270, 400; 92/71, 12.2; 192/55.3

[56] References Cited

U.S. PATENT DOCUMENTS

| | | | |
|---|---|---|---|
| 4,664,604 | 5/1987 | Terauchi | 417/222 |
| 4,776,259 | 10/1988 | Takai | 92/71 |
| 4,948,343 | 8/1990 | Shimizu | 417/222 |
| 5,741,122 | 4/1998 | Yokono et al. | 417/222.2 |
| 5,802,954 | 9/1998 | Ikeda et al. | 92/71 |
| 5,873,706 | 2/1999 | Kawabata | 417/295 |
| 5,893,706 | 4/1999 | Kawaguchi et al. | 417/373 |
| 5,899,811 | 5/1999 | Kishibuchi et al. | 464/30 |

FOREIGN PATENT DOCUMENTS

| | | |
|---|---|---|
| 0340024 | 11/1989 | European Pat. Off. . |
| 0635640 | 1/1995 | European Pat. Off. . |
| 0707182 | 4/1996 | European Pat. Off. . |
| 19635738 | 3/1997 | Germany . |
| 63-19083 | 8/1988 | Japan . |

*Primary Examiner*—Thomas N. Moulis
*Assistant Examiner*—Mahmoud M Gimie
*Attorney, Agent, or Firm*—Baker Botts, L.L.P.

[57] ABSTRACT

In a variable-displacement compressor of a swash plate type having a drive shaft (3) with axial ends one of which is connected to a compression mechanism, the drive shaft is urged in an outward direction which is directed from the one to another of the axial ends. A housing (2) has a cylindrical portion (21*a*) at an end thereof in a predetermined direction. The cylindrical portion extends in the predetermined direction. The drive shaft is rotatably held to the housing and extends within the cylindrical portion. When the drive shaft is rotated, the compression mechanism carries out a predetermined compressing operation.

20 Claims, 6 Drawing Sheets

VARIABLE-DISPLACEMENT COMPRESSOR OF A SWASH PLATE TYPE, IN WHICH DISPLACEMENT OF A DRIVE SHAFT IS SUPPRESSED

BACKGROUND OF THE INVENTION

This invention relates to a variable-displacement compressor of a swash plate type known in the art.

Japanese Unexamined Utility Model Publication (JP-U) No. 19083/1988 discloses an example of such a compressor. The compressor includes a drive shaft continuously rotated while the compressor is driven. Hereinafter, such a compressor will be called a direct-coupled pulley type.

Referring to FIG. 1, description will be made as regards a conventional variable-displacement compressor 1 of the direct-coupled pulley type. The conventional variable-displacement compressor 1 comprises a housing 2 having, at an end thereof in a predetermined direction, a cylindrical portion 21*a* extending in the predetermined direction, a drive shaft 3 rotatably held to the housing 2 and extending within the cylindrical portion 21*a* to have a first and a second axial end opposite to each other, a compression mechanism connected to the first axial end of the shaft 3 and contained in the housing 1 for carrying out a predetermined compressing operation in the manner known in the art.

The conventional variable-displacement compressor 1 further comprises a pulley 4 rotatably supported on the cylindrical portion 21*a* to be coaxial with the shaft 3, and a rotation transmission plate 5 coupling the pulley 4 and the shaft 3 to each other to directly transmit a rotary torque of the pulley 4 to the shaft 3. The rotation transmission plate 5 has a torque limiting mechanism for limiting the rotary torque in the manner known in the art.

The conventional variable-displacement compressor is operable independent of an ambient temperature as far as a compressor drive source is operated. In the variable-displacement compressor of the swash plate type, the housing 2 defines a crankcase having a crankcase pressure which is controlled to regulate a cooling ability. When the ambient temperature is low, the cooling ability of a low level is sufficient. In this event, the crankcase pressure is increased to decrease the cooling ability.

When the cooling ability is decreased beyond a predetermined level, the crankcase pressure will dramatically increase. In this state, the shaft 3 is subjected to retracting force acting in a thrust direction, namely, the predetermined direction so that the shaft 3 will be retracted into the housing 2 in the manner known in the art. As illustrated in FIG. 1, the retracting force is received by a positioning nut 19 disposed at a center portion of a cylinder block 23 and a thrust bearing 20 facing the first axial end of the shaft 3 in the predetermined direction.

As described in the foregoing, the variable-displacement compressor of the direct-coupled pulley type is continuously operated independent of the ambient temperature. If the ambient temperature is kept low, the shaft is continuously subjected to the above-mentioned retracting force in the thrust direction. This means that the thrust bearing facing the first axial end of the shaft continuously receives the retracting force and often suffers a defect such as a seizure.

SUMMARY OF THE INVENTION

It is therefore an object of this invention to provide a variable-displacement compressor of a swash plate type in which a drive shaft is kept at a desired position even when a cooling ability is decreased beyond a predetermined level thereof.

It is another object of this invention to provide a variable-displacement compressor of the type described, which is capable of eliminating an unfavorable seizure of a thrust bearing facing the drive shaft.

It is still another object of this invention to provide a variable-displacement compressor of the type described, which is capable of eliminating the thrust bearing itself.

Other objects of this invention will become clear as the description proceeds.

According to a first aspect of this invention, there is provided a variable-displacement compressor of a swash plate type, comprising a housing having, at an end thereof in a predetermined direction, a cylindrical portion extending in the predetermined direction, a drive shaft rotatably held to the housing and extending within the cylindrical portion to have a first and a second axial end opposite to each other, and a compression mechanism connected to the first axial end of the drive shaft for carrying out a predetermined compressing operation. In the variable-displacement compressor, the variable-displacement compressor further comprises urging means operatively connected to the drive shaft for urging the drive shaft in an outward direction which is directed from the first axial end to the second axial end in the predetermined direction.

According to a second aspect of this invention, there is provided a variable-displacement compressor of a swash plate type, comprising a housing having, at an end thereof in a predetermined direction, a cylindrical portion extending in the predetermined direction, a drive shaft rotatably held to the housing and extending within the cylindrical portion to have a first and a second axial end opposite to each other, and a compression mechanism connected to the first axial end of the drive shaft for carrying out a predetermined compressing operation. In the variable-displacement compressor, the variable-displacement compressor further comprises preventing means operatively connected to the drive shaft for preventing the drive shaft from being moved in an inward direction which is directed from the second axial end to the first axial end in the predetermined direction.

According to a third aspect of this invention, there is provided a variable-displacement compressor of a swash plate type, comprising a housing having a cylindrical portion, a drive shaft rotatably supported within the housing and having a first axial end and a second axial end which protrudes outward through the cylindrical portion, a compression mechanism connected to the first axial end of the drive shaft for carrying out a predetermined compressing operation, a pulley rotatably fitted on the cylindrical portion to be coaxial with the drive shaft, and a torque limiting mechanism coupling the pulley and the drive shaft to each other and limiting a torque transmitted from the pulley to the drive shaft. In the variable-displacement compressor, the torque limiting mechanism urges the drive shaft in a protruding direction such that the second axial end of the shaft is protruded outward through the cylindrical portion According to a fourth aspect of this invention, there is provided a variable-displacement compressor of a swash plate type, comprising a housing having a cylindrical portion, a shaft rotatably supported within the housing and having a first axial end and a second axial end which protrudes outward through the cylindrical portion, a compression mechanism connected to the first axial end of the drive shaft for carrying out a predetermined compressing operation, a pulley rotatably fitted on the cylindrical portion to be coaxial with the drive shaft, and a torque limiting mechanism coupling the pulley and the drive shaft to each other and limiting a torque transmitted from the pulley to the drive shaft. In the variable-displacement compressor, the torque limiting mechanism is adapted to lock the drive shaft at a retracted position where the second axial end of the shaft is retracted from the protruding position into the cylindrical portion by a predetermined distance.

DESCRIPTION OF THE PREFERRED EMBODIMENTS

Figure 1:
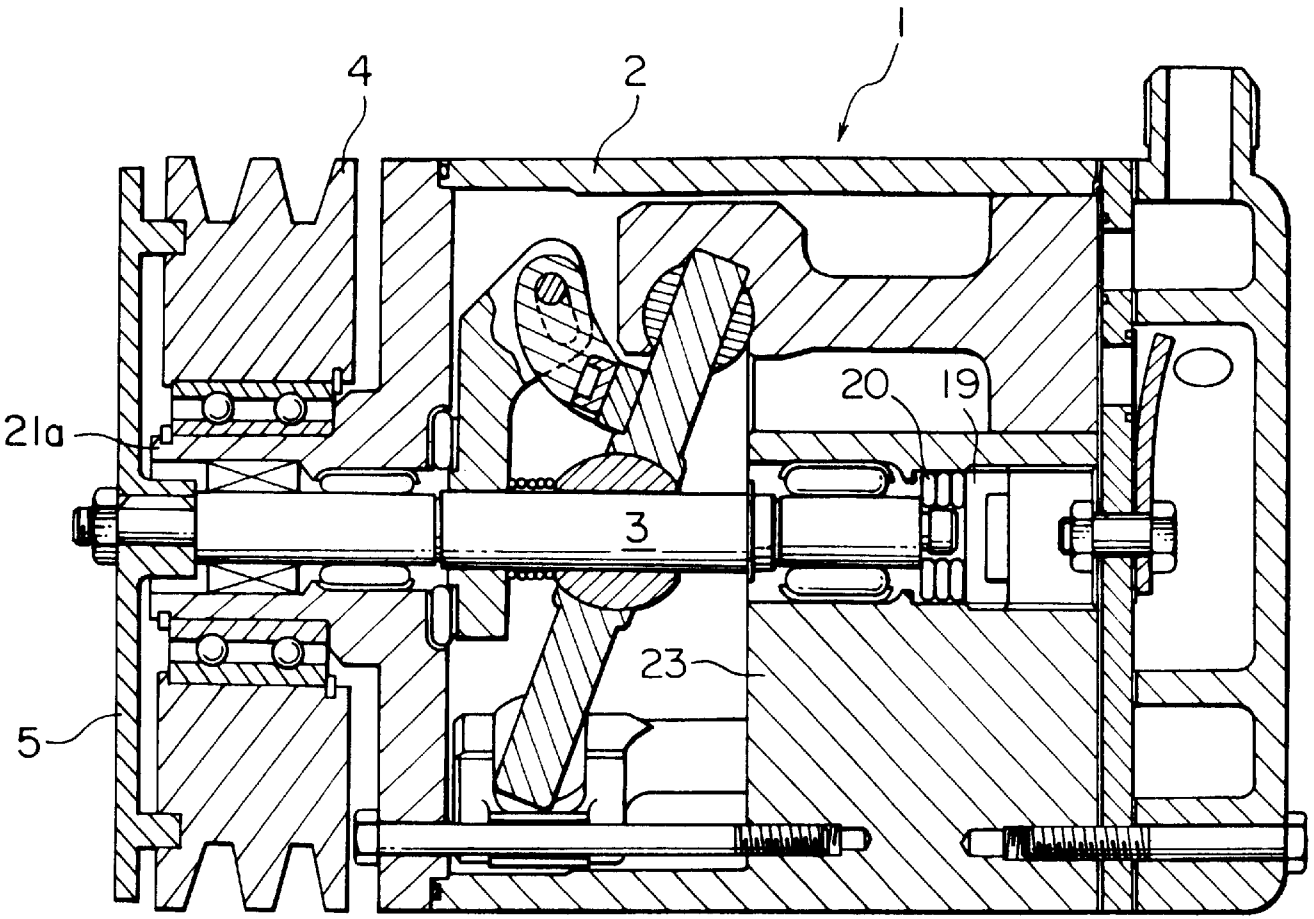
FIG. 1 PRIOR ART
FIG. 1 is a vertical sectional view of a conventional variable-displacement compressor of a swash plate type.

Now, description will be made about this invention in conjunction with several preferred embodiments with reference to the drawing.

Figure 2:
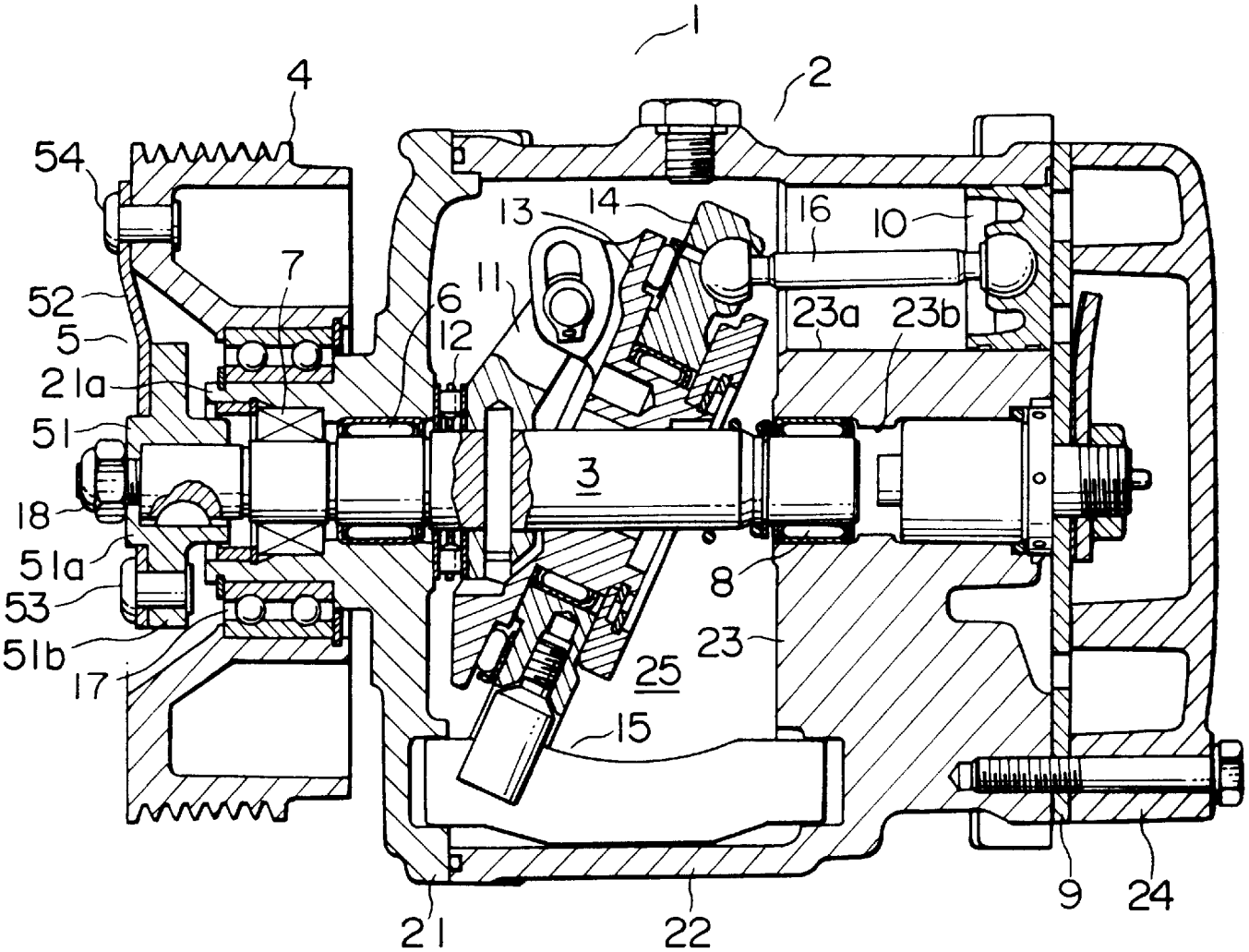
FIG. 2 is a vertical sectional view of a variable-displacement compressor according to a first embodiment of this invention.
Figure 3:
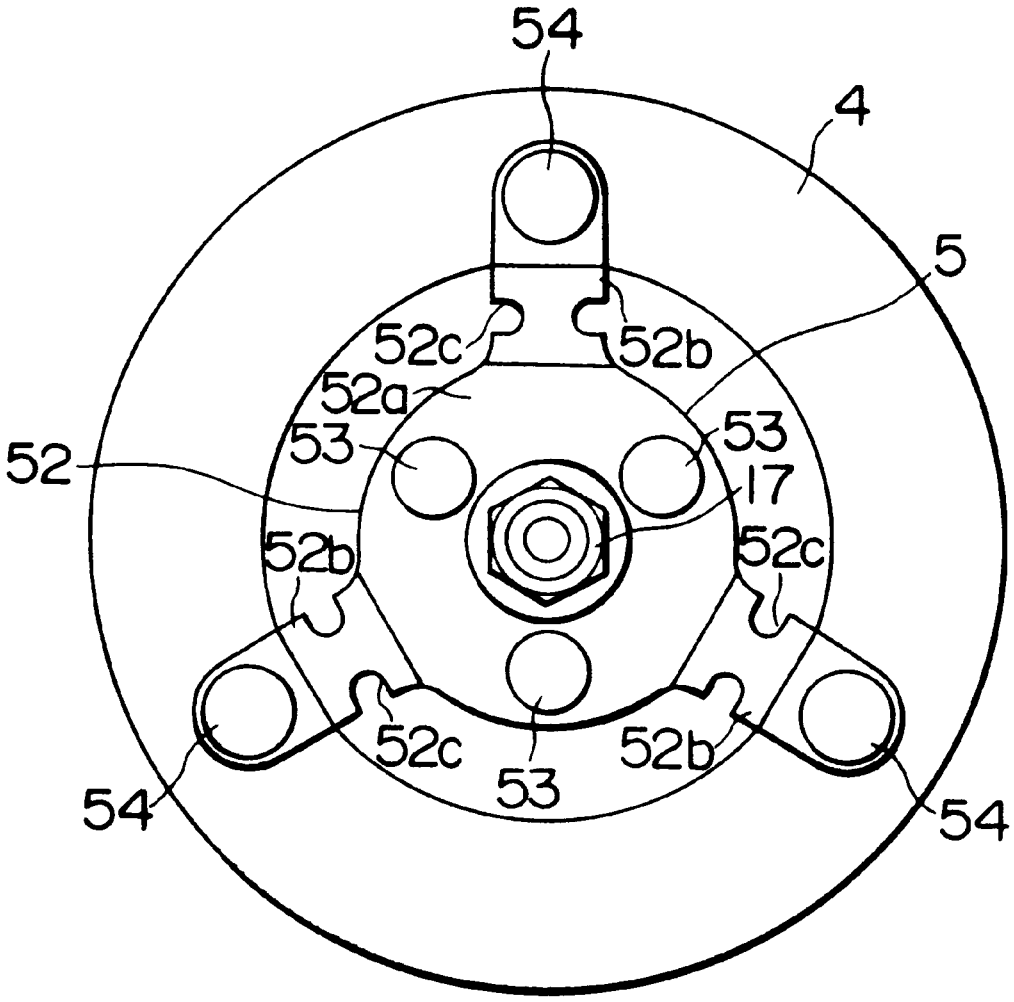
FIG. 3 is a front view of the compressor illustrated in FIG. 2.

Referring to FIGS. 2 and 3, the description will be made as regards a variable-displacement compressor 1 of a swash plate type according to a first embodiment of this invention. The variable-displacement compressor 1 is of a direct-coupled pulley type known in the art and comprises similar parts designated by like reference numerals.

In the variable-displacement compressor 1, the housing 2 comprises a front housing 21, a housing body 22, a cylinder block 23, and a cylinder head 24. The front housing 21 is of a generally funnel-like shape and has a cylindrical portion 21*a*. At the center of the front housing 21, a radial needle bearing 6 is disposed. Within the cylindrical portion 21*a*, a shaft seal member 7 is arranged. The housing body 22 is of a generally cylindrical shape and has one end closed by the front housing 21. Thus, a crankcase 25 is defined between the front housing 21 and the cylinder block 23. The cylinder block 23 is integral with the housing body 22 and has a cylinder bore 23*a*. At the center of the cylinder block 23, a center hole 23*b* is formed. Within the center hole 23*b*, a radial ball bearing 8 is disposed. The cylinder head 24 is attached to the other end of the housing body 22 through a valve plate 9. In the cylinder bore 23*a*, a piston 10 is slidably inserted.

The shaft 3 is rotatably supported in the housing 2 by the radial needle bearings 6 and 8 disposed in the front housing 21 and at the center of the cylinder block 23, respectively. The shaft 3 has one end protruding outward from the housing 2 through the shaft seal member 7 and the cylindrical portion 21 to a protruding position. A rotor 11 is fixed to the shaft 3. A thrust needle bearing 12 is interposed between the rotor 11 and the front housing 21. Furthermore, a swash plate 13 is attached to the shaft 3. The swash plate 13 is coupled to the rotor 11 to be variable in its inclination angle. A wobble plate 14 is attached to the swash plate 13 to allow the rotation of the swash plate 13. The wobble plate 14 itself is inhibited by a rotation stopper 15 disposed in the housing 2 from rotating (revolving around its own axis). The wobble plate 14 is coupled to the piston 10 via a piston rod 16.

The pulley 4 is rotatably attached or supported through a radial ball bearing 17 on the cylindrical portion 21*a* of the front housing 21 to be coaxial with the shaft 3. The rotation transmission plate 5 comprises a fixed member 51 and an elastic plate 52. The fixed member 51 comprises a cylindrical portion 51*a* and a flange portion 51*b* formed at an outer periphery of the cylindrical portion 51*a*. The fixed member 51 is made of a rigid material. The cylindrical portion 52*a* is fixed by a nut 18 to the second axial end of the shaft 3.

The elastic plate 52 comprises a disk-shaped portion 52*a* and a plurality of protruding portions 52*b* radially protruding from an outer periphery of the disk-shaped portion 52*a*. The elastic plate 52 is made of an elastic material. The disk-shaped portion 52*a* of the elastic plate 52 is fixed by a plurality of rivets 53 to the flange portion 51*b* of the fixed portion 51. Thus, the fixed portion 51 and the elastic plate 52 are integrally coupled to form the rotation transmission plate 5. The rotation transmission plate 5 is fixed by a nut 18 to the second axial end of the shaft 3. Each protruding portion 52*b* at a top end of the elastic plate 52 of the rotation transmission plate 5 is coupled by the rivet 54 to the pulley 4.

Each of the protruding portions 52*b* of the elastic plate 52 comprises a spring portion extending from the disk-shaped portion 52*a* and a fixed portion integral with the spring portion and fixed to an axial end surface of the pulley 4 by a rivet 54. The rotation transmission plate 5 will be referred to as a torque transmitting arrangement. A combination of the fixed member 51 and the disk-shaped portion 53*a* will be referred to as a first portion of the torque transmitting arrangement. The fixed portion of each of the protruding portions 52*b* will be called a second portion of the torque transmitting arrangement. The spring portion of each of the protruding portions 52*b* will be called a third portion of the torque transmitting arrangement.

Furthermore, each protruding portion 52*b* is provided with a pair of notches 52*c*. By presence of the notches 52*c*, the rotation transmission plate 5 can be broken when the rotation transmission plate 5 is subjected to a rotary torque not smaller than a predetermined value. The notches 52*c* will be referred to as a torque limiting arrangement for limiting transmission of the torque to the shaft 3 in response to an overload of the shaft 4. More particularly, the notches 52*c* are broken when the shaft 3 is subjected an overload.

As will be seen from FIG. 2, each protruding portion 52*b* is elastically deformed leftward in the figure. Therefore, the elastic plate 52 continuously presses the pulley 4 rightward in FIG. 2. Since the pulley 4 can not be moved in an axial direction of the shaft 3, reaction force is produced and the rotation transmission plate 5 urges the shaft 3 in a protruding direction such that the one end of the shaft 3 is protruded from the cylindrical portion 21*a*. When the crankcase pressure is increased and retracting force is produced to retract the one end of the shaft 3 into the housing 2, the above-mentioned urging force of the rotation transmission plate 5 cancels the retracting force. The spring portion of each of the protruding portions 52*b* is referred to as an urging arrangement for urging the shaft 3 in an outward direction which is directed from the first axial end to the second axial end in the predetermined direction.

Figure 4:
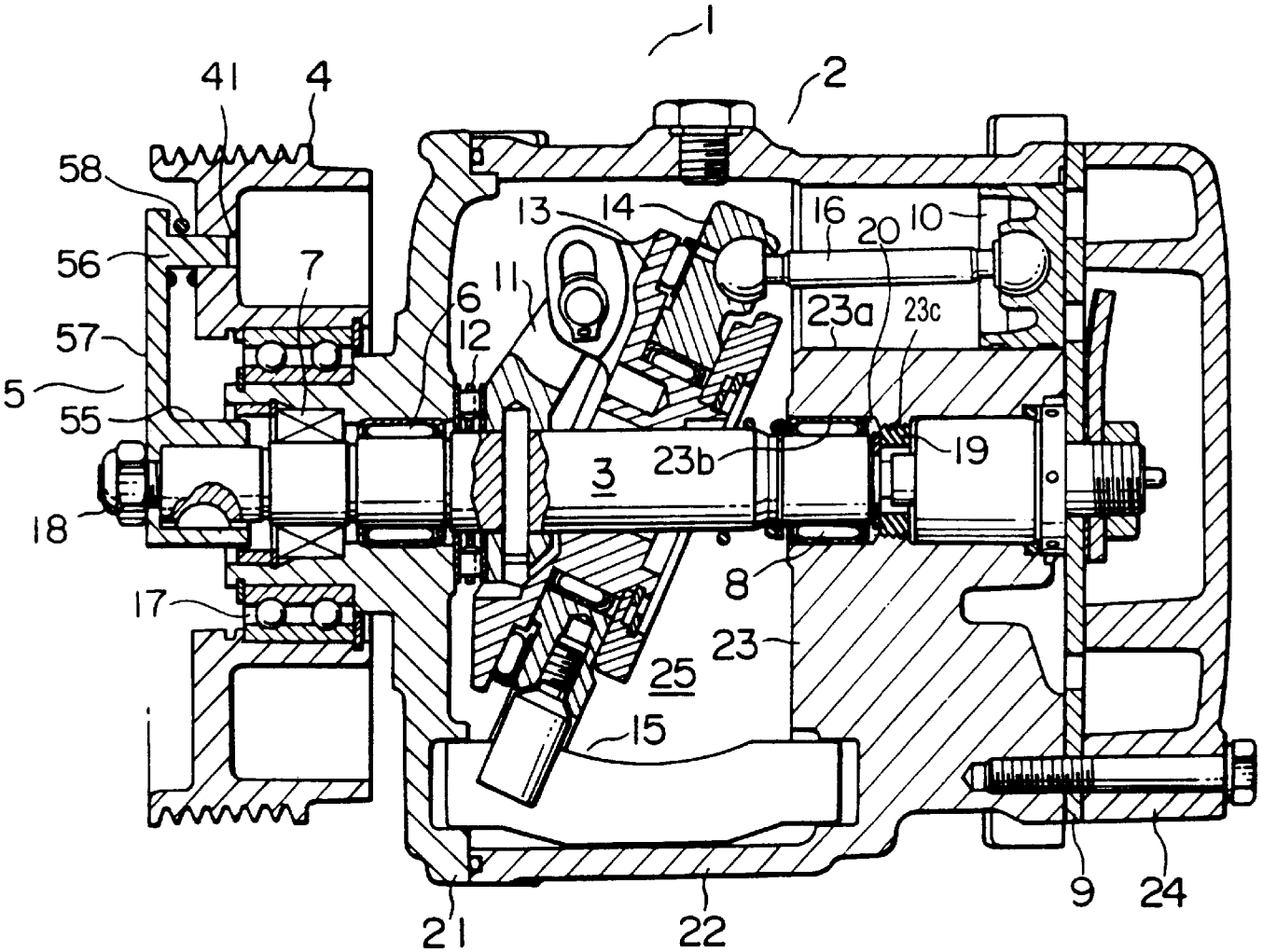
FIG. 4 is a vertical sectional view of a variable-displacement compressor according to a second embodiment of this invention.

Referring to FIG. 4, a variable-displacement compressor according to a second embodiment of this invention is substantially similar in structure to the first embodiment except those portions which will hereinunder be described. Similar parts are designated by like reference numerals and will not be described any longer.

In the second embodiment, a female thread 23*c* is formed at a part of an inner peripheral wall of the center hole 23*b* of the cylinder block 23. A positioning nut 19 is screwed into the female thread 23*c*. Between the positioning nut 19 and the other end of the shaft 3, a thrust bearing 20 is interposed.

The pulley 4 of this embodiment is provided with a through hole 41 formed at its outer periphery. The through hole 41 extends in the axial direction of the shaft 3.

The rotation transmission plate 5 comprises a fixed portion 55 fixed to the shaft 3, a columnar portion 56 removably inserted into the through hole 41 of the pulley 4, a coupling portion 57 coupling the columnar portion 56 and the fixed portion 55 to each other, and a spring 58 wound around the columnar portion 56 to be interposed between the coupling portion 57 and the pulley 4. In this embodiment, reaction force is produced when the spring 58 presses the pulley 4 towards the front housing 21. The reaction force urges the shaft 3 in the protruding direction.

Figure 5:
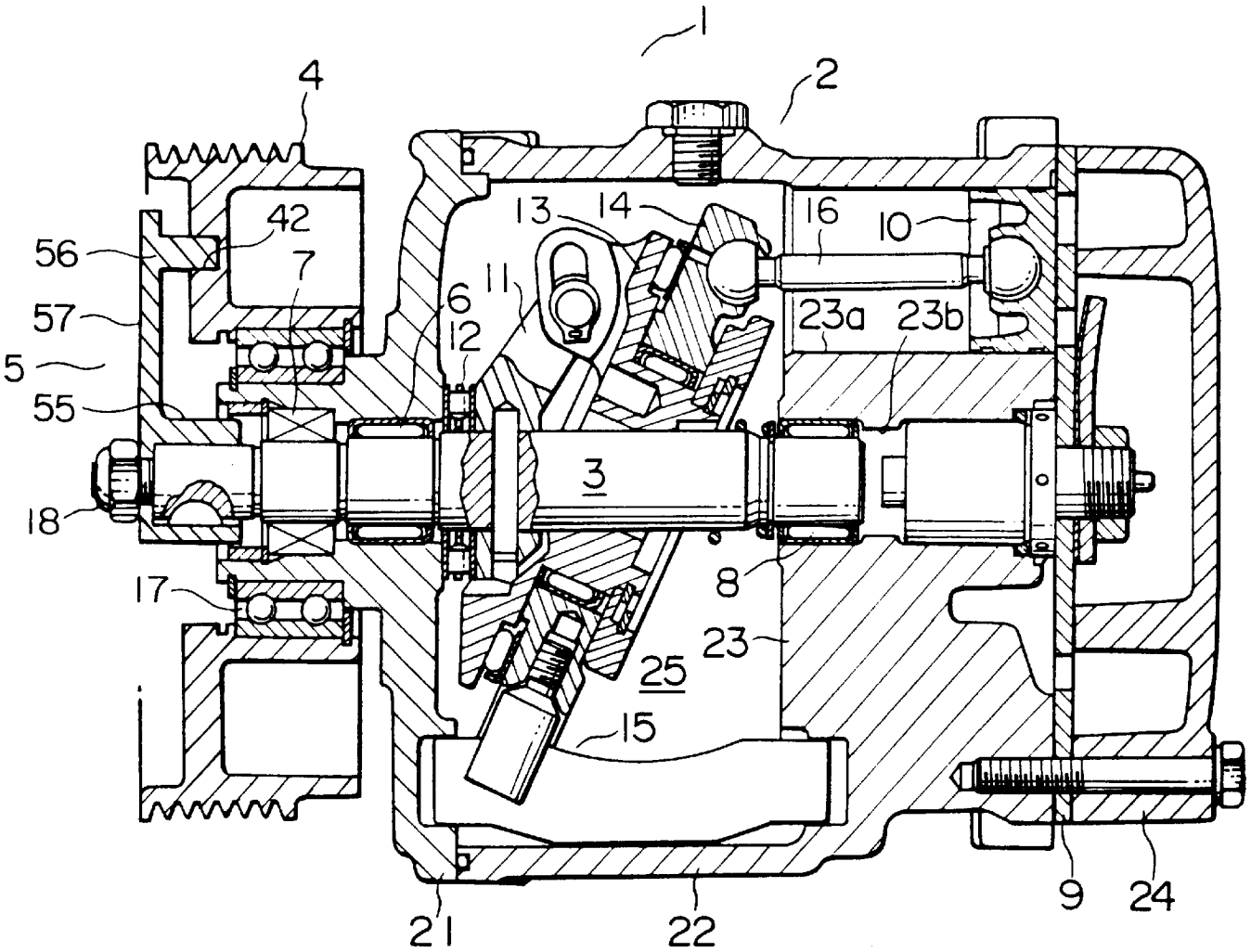
FIG. 5 is a vertical sectional view of a variable-displacement compressor according to a third embodiment of this invention.

Referring to FIG. 5, a variable-displacement compressor according to a third embodiment of this invention is substantially similar to the second embodiment except those portions which will hereinunder be described. Similar parts are designated by like reference numerals and will not be described any longer. The positioning nut 19 and the thrust bearing 20 in the second embodiment are omitted.

In the third embodiment, a bottomed hole 42 is formed in an outer periphery of the pulley 4. The bottomed hole 42 extends in the axial direction of the shaft 3.

The rotation transmission plate 5 does not include the spring 58 used in the second embodiment. Instead, one end of the columnar portion 56 of the rotation transmission plate 5 is adapted to be brought into contact with a bottom of the bottomed hole 42. By such contact or engagement, the rotation transmission plate 5 locks the shaft 3 at a retracted position where the one end of the shaft 3 is retracted from the protruding position into the cylindrical portion 21*a* by a predetermined distance.

In the third embodiment, the rotation transmission plate 5 locks the shaft 3 at the retracted position where the second axial end of the shaft 3 is retracted from the protruding position into the cylindrical portion 21*a* by the predetermined distance. When the crankcase pressure is increased and the retracting force is produced to retract the second axial end of the shaft 3 into the cylindrical portion 21*a* by the predetermined distance, the rotation transmission plate 5 locks the shaft 3 at that position. Therefore, the second axial end of the shaft 3 is no longer retracted into the cylindrical portion 21*a*. The rotation transmission plate 5 is referred to as a preventing arrangement for preventing the drive shaft from being moved in an inward direction which is directed from the second axial end to the first axial end in the predetermined direction.

Figure 7:
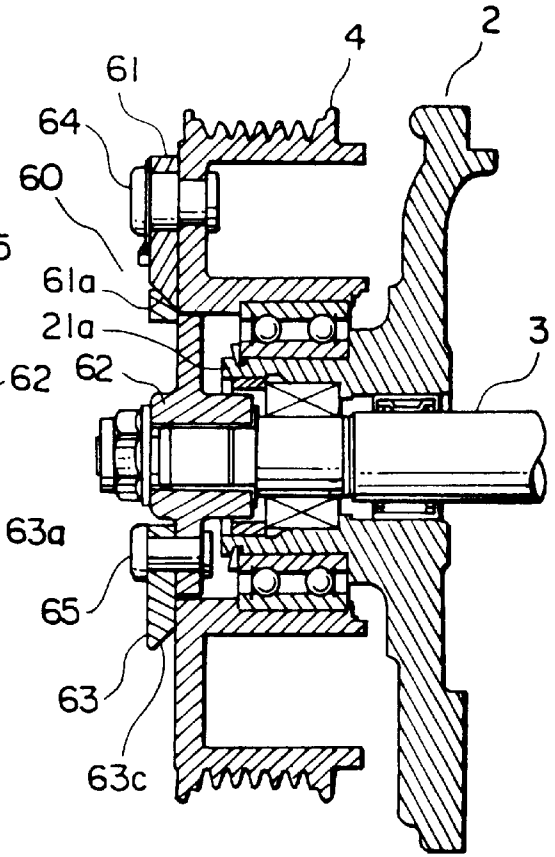
FIG. 7 and a vertical sectional view of the compressor illustrated in FIG. 6.
Figure 6:
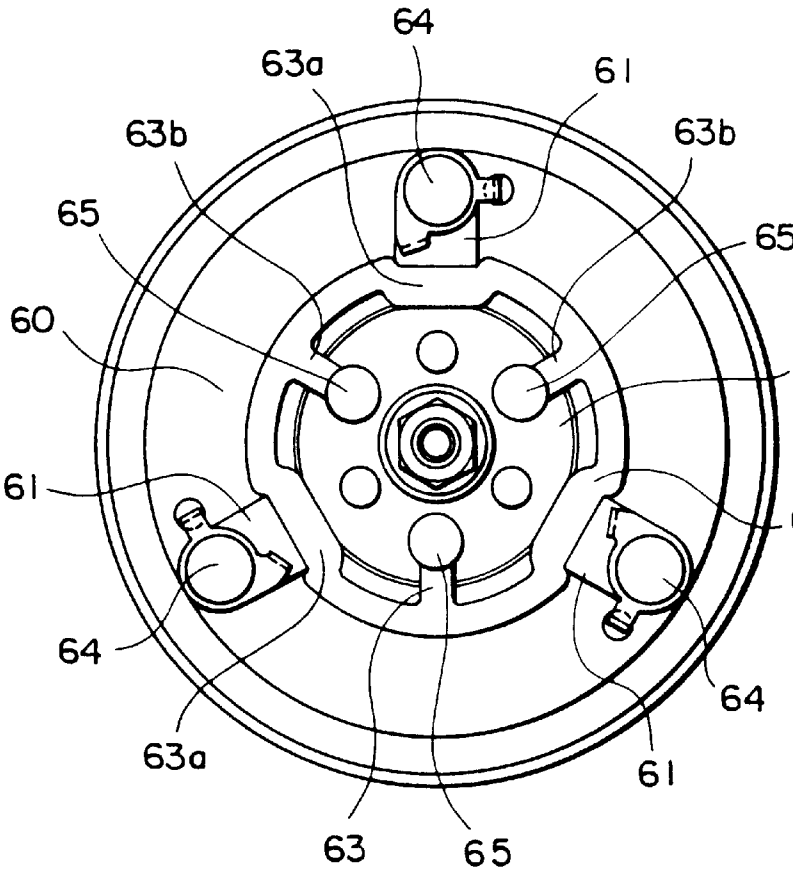
FIG. 6 is a front view of a variable-displacement compressor according to a fourth embodiment of this invention.

Referring to FIGS. 6 and 7, a variable-displacement compressor according to a fourth embodiment of this invention is substantially similar to the third embodiment except the torque limiting mechanism which will hereinunder be described. Similar parts are designated by like reference numerals and will not be described any longer.

In this embodiment, the torque limiting mechanism comprises a torque limiter 60. In the manner which will presently be described, the torque limiter 60 comprises a plurality of arms 61, a boss 62, and a ring-shaped elastic member 63.

The arms 61, three in number in the illustrated example, are of a generally stem-like shape and equiangularly spaced at the outer periphery of the pulley 4. Each arm 61 has one end attached by a rivet 64 to the outer periphery of the pulley 4 so that the arm 61 is rotatable. The rotation of the arm 61 is not started until the rotary torque not smaller than the predetermined value is applied to the arm 61. Each arm 61 has an inclined surface 61*a* at the other end. The inclined surface 61*a* is inclined to become farther from an arm attaching surface of the pulley 4 outwards in a radial direction of the pulley 4.

The boss 62 has a generally disk-like shape and is fixed to the one end of the shaft 3 protruding from the cylindrical portion 21*a* of the housing 2.

The ring-shaped elastic member 63 is of a generally ring-like shape and has a plurality of recessed portions 63*a* recessed inward in its radial direction, and a plurality of coupling portions 63*b* protruding inward in the radial direction. The ring-shaped elastic body 63 has an outer peripheral surface as a tapered surface 63*c*. The tapered surface 63*c* is tapered towards the pulley 4. The ring-shaped elastic body 63 is fixed to the boss 62 by a plurality of rivets 65 at inner positions of the coupling portions 63*b* so as to face one surface (opposite to the other surface facing the housing 2) of the pulley 4 in the axial direction of the shaft 3. The tapered surface 63*c* of the ring-shaped elastic body 63 is brought into contact with the inclined surfaces 61*a* of the arms 61 in the axial direction of the shaft 3.

When the other end of each arm 61 is fitted into each recessed portion 63*a* of the ring-shaped elastic body 63, the ring-shaped elastic body 63 presses each arm 61 against the pulley 4 in the axial direction of the shaft 3. Thus, the rotary torque is transmitted from the pulley 4 to the shaft 3 through the torque limiter 60. If the rotary torque not smaller than the predetermined value is transmitted to the torque limiter 60, the arms 61 are rotated and the ring-shaped elastic body 63 is separated from the pulley 4 to release the engagement between the arms 61 and the ring-shaped elastic body 63. As a result, the rotary torque is not transmitted from the pulley 4 to the shaft 3.

The arm 61 and the ring-shaped elastic body 63 are arranged so that the inclined surfaces 61*a* and the tapered surface 63*c* can be brought into contact with each other in the axial direction. When the one end of the shaft 3 is retracted from the protruding position into the cylindrical portion 21*a* by the predetermined distance, the tapered surface 63*c* of the ring-shaped elastic body 63 is brought into contact with the inclined surfaces 61*a* of the arms 61. As a result, the shaft 3 is locked at that position and is inhibited from being retracted further into the cylindrical portion 21*a*.

As described above, even if the ambient temperature is kept low and the retracting force is produced to retract the one end of the shaft into the housing, the retracting force is cancelled in the variable-displacement swash-plate compressor of a direct-coupled pulley type according to this invention. This is because the shaft is urged by the rotation transmission plate in the protruding direction opposite to the retracting direction or alternatively because the shaft is locked by the pulley via the rotation transmission plate when the one end of the shaft is retracted into the housing by the predetermined distance from the protruding position. Therefore, the retracting force does not act on the thrust bearing facing the other end of the shaft. As a result, the thrust bearing is not subjected to unusual force and is therefore prevented from a defect such as a seizure.

Furthermore, it is possible in this invention to dispense with the thrust bearing itself which is required in the prior art and disposed opposite to the other end of the shaft. This is because, even if the retracting force is produced while the ambient temperature is kept low, the retracting force is effectively resisted or cancelled.

While the present invention has thus far been described in conjunction with a few embodiments thereof, it will be possible for those skilled in the art to put this invention into practice in various other manners. For example, the shaft may be urged by the ring-shaped elastic body in the first direction.

What is claimed is:

1. A variable-displacement compressor of a swash plate type, comprising:

a housing having, at an end thereof in a predetermined direction, a cylindrical portion extending in said predetermined direction;

a drive shaft rotatably held to said housing and extending within said cylindrical portion to have a first and a second axial end opposite to each other; and a compression mechanism connected to said first axial end of the drive shaft for carrying out a predetermined compressing operation, said variable-displacement compressor further comprising urging means operatively connected to said second axial end of the drive shaft for urging said drive shaft in an outward direction which is directed from said first axial end to said second axial end in said predetermined direction.

2. A variable-displacement compressor as claimed in claim 1, further comprising:

a pulley rotatably supported on said cylindrical portion to be coaxial with said drive shaft; and torque transmitting means connected to said pulley and said second axial end of the drive shaft for transmitting a torque of said pulley to said drive shaft, said urging means being connected to said torque transmitting means to urge said drive shaft through said torque transmitting means in said outward direction.

3. A variable-displacement compressor as claimed in claim 2, further comprising torque limiting means connected to said torque transmitting means for limiting transmission of said torque to said drive shaft in response to an overload of said drive shaft.

4. A variable-displacement compressor as claimed in claim 2, wherein said torque transmitting means comprises:

a first portion connected to said second axial end of the drive shaft;

a second portion connected to said pulley; and a third portion connected between said first and said second portion, said third portion being made of an elastic member to serve as said urging means.

5. A variable-displacement compressor as claimed in claim 4, further comprising torque limiting means connected to said third portion for breaking said elastic member to limit transmission of said torque to said drive shaft when said drive shaft is subjected to an overload.

6. A variable-displacement compressor as claimed in claim 4, further comprising torque limiting means between said second and said third portions for disconnecting said second and said third portions from each other to limit transmission of said torque to said drive shaft when said drive shaft is subjected to an overload.

7. A variable-displacement compressor as claimed in claim 2, wherein said torque transmitting means is movable relative to said pulley in said outward direction, said urging means comprising a spring between said pulley and said torque transmitting means for urging said torque transmitting means in said outward direction.

8. A variable-displacement compressor as claimed in claim 7, further comprising torque limiting means connected to said torque transmitting means for being broken to limit transmission of said torque to said drive shaft when said drive shaft is subjected an overload.

9. A variable-displacement compressor as claimed in claim 7, wherein said torque transmitting means is made of a rigid member.

10. A variable-displacement compressor of a swash plate type, comprising:

a housing having, at an end thereof in a predetermined direction, a cylindrical portion extending in said predetermined direction;

a drive shaft rotatably held to said housing and extending within said cylindrical portion to have a first and a second axial end opposite to each other; and a compression mechanism connected to said first axial end of the drive shaft for carrying out a predetermined compressing operation, said variable-displacement compressor further comprising preventing means operatively connected to said second axial end of the drive shaft for preventing said drive shaft from being moved in an inward direction which is directed from said second axial end to said first axial end in said predetermined direction.

11. A variable-displacement compressor as claimed in claim 10, further comprising:

a pulley rotatably supported on said cylindrical portion to be coaxial with said drive shaft; and torque transmitting means engaged with said pulley in a rotation direction thereof and fixed to said second axial end of the drive shaft for transmitting a torque of said pulley to said drive shaft, said torque transmitting means being made of a rigid member and being further engaged with said pulley in said inward direction to serve as said preventing means.

12. A variable-displacement compressor as claimed in claim 11, further comprising torque limiting means connected to said torque transmitting means for being broken to limit transmission of said torque to said drive shaft when said drive shaft is subjected to an overload.

13. A variable-displacement compressor of a swash plate type, comprising:

a housing having a cylindrical portion;

a drive shaft rotatably supported within said housing and having a first axial end and a second axial end which protrudes outward through said cylindrical portion;

a compression mechanism connected to said first axial end of the drive shaft for carrying out a predetermined compressing operation;

a pulley rotatably fitted on said cylindrical portion to be coaxial with said drive shaft; and a torque limiting mechanism coupling said pulley and said drive shaft to each other and limiting a torque transmitted from said pulley to said drive shaft, said torque limiting mechanism comprising a rotation transmission plate having a portion fixed to said second axial end of the drive shaft and the other portion coupled to said pulley so as to transmit said torque of said pulley to said drive shaft, said rotation transmission plate urging said drive shaft in a protruding direction such that said second axial end of the shaft is protruded outward through said cylindrical portion.

14. A variable-displacement compressor as claimed in claim 13, wherein said rotation transmission plate is at least partially broken when said torque not smaller than a predetermined value is received.

15. A variable-displacement compressor as claimed in claim 14, wherein said rotation transmission plate comprises a fixed portion fixed to said drive shaft and an elastic plate having one end fixed to said fixed portion and the other end fixed to said pulley, said elastic plate urging said drive shaft in said protruding direction.

16. A variable-displacement compressor as claimed in claim 14, wherein said rotation transmission plate comprises:

a fixed portion fixed to said drive shaft;

a columnar portion removably inserted into a through hole formed in said pulley to extend in an axial direction of said dirive shaft;

a coupling portion coupling said columnar portion and said fixed portion to each other; and a spring wound around said columnar portion to be interposed between said coupling portion and said pulley, said spring urging said drive shaft in said protruding direction.

17. A variable-displacement compressor of a swash plate type, comprising:

a housing having a cylindrical portion;

a shaft rotatably supported within said housing and having a first axial end and a second axial end which protrudes outward through said cylindrical portion;

a compression mechanism connected to said first axial end of the drive shaft for carrying out a predetermined compressing operation;

a pulley rotatably fitted on said cylindrical portion to be coaxial with said drive shaft; and a torque limiting mechanism coupling said pulley and said drive shaft to each other and limiting a torque transmitted from said pulley to said drive shaft, said torque limiting mechanism being adapted to lock said drive shaft at a retracted position where said second axial end of the shaft is retracted from said protruding position into said cylindrical portion by a predetermined distance.

18. A variable-displacement compressor as claimed in claim 17, wherein said torque limiting mechanism comprises a rotation transmission plate having a portion fixed to said second axial end of the shaft and the other portion coupled to said pulley so as to transmit said torque of said pulley to said drive shaft, said rotation transmission plate being at least partially broken when said torque not smaller than a predetermined value is received.

19. A variable-displacement compressor as claimed in claim 18, wherein said rotation transmission plate comprises;

a fixed portion fixed to said drive shaft;

a columnar portion removably inserted into a bottomed hole formed in said pulley to extend in an axial direction of said drive shaft; and a coupling portion coupling said columnar portion and said fixed portion to each other, said rotation transmission plate locking said drive shaft at said retracted position by said contact between said columnar portion and a bottom of said bottomed hole.

20. A variable-displacement compressor as claimed in claim 17, wherein said torque limiting mechanism comprises:

a torque limiter having an arm attached to said pulley so as to rotate when said torque not smaller than a predetermined value is received;

a boss fixed to said second axial end of the drive shaft; and a ring-shaped elastic member fixed to said boss and holding said arm in an axial direction of said drive shaft, said torque limiter locking said drive shaft at said retracted position by said engagement of said arm and said ring-shaped elastic member in said axial direction.

* * * * *